United States Patent [19]

Aldridge et al.

[11] Patent Number: 4,992,163

[45] Date of Patent: Feb. 12, 1991

[54] CAT CRACKING FEED PREPARATION

[75] Inventors: Clyde L. Aldridge; Roby Bearden, Jr., both of Baton Rouge, La.

[73] Assignee: Exxon Research and Engineering Company, Florham Park, N.J.

[21] Appl. No.: 449,178

[22] Filed: Dec. 13, 1989

[51] Int. Cl.[5] ..... C10G 31/00

[52] U.S. Cl. ..... 208/251 H; 208/86; 208/87; 208/88; 208/89; 208/92; 208/251 R; 208/309

[58] Field of Search ..... 208/251 H, 251 R, 92, 208/88, 84

[56] References Cited

U.S. PATENT DOCUMENTS

| | | | |
|---|---|---|---|
| 2,884,369 | 4/1959 | Mattox et al. | 208/251 R |
| 2,929,776 | 3/1960 | Padovani et al. | 208/251 H |
| 2,938,857 | 5/1960 | Johnson et al. | 208/251 R |
| 2,944,013 | 7/1960 | Holden | 208/251 H |
| 3,013,962 | 12/1961 | Kimberlin, Sr. et al. | 208/251 R |
| 3,095,368 | 6/1963 | Bieber et al. | 208/251 R |
| 3,227,645 | 1/1966 | Frumkin et al. | 208/251 R |
| 3,684,688 | 8/1972 | Roselius | 208/251 H |
| 3,915,842 | 10/1975 | Gatsis | 208/251 H |
| 4,073,721 | 2/1978 | Kanbier et al. | 208/251 H |
| 4,430,206 | 2/1984 | Ranker | 208/251 H |
| 4,434,048 | 2/1984 | Schindler | 208/251 H |
| 4,435,277 | 3/1984 | Dinh et al. | 208/251 H |
| 4,705,619 | 11/1987 | McCandlish et al. | 208/251 H |

FOREIGN PATENT DOCUMENTS

| | | | |
|---|---|---|---|
| 1181846 | 11/1964 | Fed. Rep. of Germany | 208/251 R |

*Primary Examiner*—Helane E. Myers

*Attorney, Agent, or Firm*—C. P. Konkol

[57] ABSTRACT

A method of reducing the concentration of metal contaminants, such as vanadium and nickel, in distillates of a fossil fuel feedstock is disclosed. The method comprises producing a selected distillate fraction and demetallizing this distillate by suitable means, thereby upgrading and making it suitable for use as feed to a catalytic cracker.

14 Claims, 3 Drawing Sheets

CAT CRACKING FEED PREPARATION

The present invention generally relates to the removal of metallic contaminants from a petroleum distillate. More particularly, the present invention relates to the removal of nickel, vanadium, iron, and/or other metal containing compounds from a pre-selected petroleum distillate fraction.

BACKGROUND OF THE INVENTION

It is well known that as a petroleum resource, e.g., a crude oil or petroleum residuum is distilled to higher cut point, the amount recovered as distillate naturally increases. However, as the cut point increases, the concentration of metallic contaminants in the distillate also tends to increase. Metal-containing compounds, including porphyrin or porphyrin-like complexes, are abundant in heavy petroleum distillates. These organo-metallic compounds can be volatized, thus contaminating the distillate fractions. For example, petroleum distillates such as gas oils for use as feed to a catalytic cracker normally may contain several ppm of metals. However, if deeper incremental distillation cuts are taken and included in the gas oil, then the metals content of such deeper incremental cuts can be much higher. For example, such deeper incremental cuts may reach 50–100 ppm Vanadium or higher. Consequently, the final distillation cut point (end point) of gas oils intended for use as cat cracker feed is conventionally not higher than about 1050° F.

In petroleum processing operations such as catalytic cracking, the presence of a high concentration of metallic contaminants in the petroleum feed leads to rapid catalyst contamination causing an undesirable increase in hydrogen and coke make, an attendant loss in gasoline yield, a loss in conversion activity and a decrease in catalyst life. The effects of these metallic contaminants on zeolite-containing catalysts are described in detail in U.S. Pat. No. 4,537,676. The metallic contaminants are believed to affect the catalyst by blocking the catalyst pore structure and by irreversibly destroying the zeolite crystallinity. The adverse catalytic effects of nickel and vanadium containing compounds, in particular, are discussed by Cimbalo, Foster and Wachtel in "Oil and Gas Journal," May 15, 1972, pages 112–122 and by Bosquet and Laboural in "Oil and Gas Journal," Apr. 20, 1987, pages 62–68.

The removal of metallic contaminants from heavy petroleum distillates such as atmospheric bottoms, heavy gas oils and vacuum gas oils, is becoming increasingly more important as heavier and more metals-contaminated feedstocks are being refined. As a consequence of significant economic incentives, additional efforts are being directed at upgrading such feeds to more valuable products. For example, a sufficiently inexpensive treat of a heavy petroleum distillate to remove metals therefrom could substantially increase the amount of cat cracker feed available.

In the past, efforts have been directed to the removal of metal contaminants from petroleum distillates by a variety of methods including hydro-treating, deasphalting, and acid extraction.

Hydrotreating technology using CoMo, and/or NiMo catalysts is used for upgrading some feeds for catalytic cracking, but a selective hydrotreating process which is capable of essentially only removing metals without consuming substantial amounts of hydrogen in other reactions has not been available.

U.S. Pat. Nos. 2,926,129 and 3,095,368 describe a method for selectively removing iron, nickel and vanadium from an asphalt-containing petroleum feedstock by deasphalting the oil and subsequently contacting the oil with a mineral acid, such as HCl, to coagulate the metallic compound. The metallic compounds are then separated. This process has the disadvantage of requiring the use of deasphalting, which is an expensive operation, and requiring mineral acids which are highly corrosive.

In a paper presented at a meeting of the ACS Division of Petroleum Chemistry Society (*Preprints*, Vol. 25, No. 2, pages 293–299, March 1980), Bukowski and Gurdzinska disclosed a method for reducing the adverse catalytic effect of metal contaminants present in the distillate from a atmospheric residuum. The method included heat treating the atmospheric residuum in the presence of cumene hydroperoxide (CHP) for up to six hours at 120° C. This step increased the distillate fraction obtained from the atmospheric residuum feed and decreased the metals content of the distillate which subsequently was used as feed for a catalytic cracking unit. This procedure has the disadvantage that the cost of the large amount (2%) of CHP used is relatively high.

British patent application No. 2,031,011 describes a method for reducing the metals and asphaltene content of a heavy oil by hydrotreating the oil in the presence of a catalyst including a metal component from Group Ib, IIb, IIa, Va, VI, and VIII of the Periodic Table and thereafter deasphalting the oil. Relatively large amounts of hydrogen are required.

Various other patents disclose upgrading a residual oil by initially deasphalting and subsequently demetallizing the deasphalted oil, for example, as variously described in U.S. Pat. Nos. 4,447,313, 2,895,902, 3,227,645, 4,165,274, 4,298,456, 3,511,774 and 3,281,350.

The teachings of the prior art, although proposing possible ways to reduce the metals content in a petroleum distillate, fail to provide a process which is sufficiently effective, practical, inexpensive, and which does not suffer from any of the above mentioned drawbacks.

BRIEF DESCRIPTION OF THE INVENTION

It is an object of the present invention to provide a process for removing metals from a petroleum distillate or other hydrocarbonaceous liquid. Applicants have found that it is advantageous to fractionate a heavy fossil fuel feedstock to obtain a selected fraction thereof characterized by a certain range of metals content, and to remove metals from that selected distillate fraction. In one particular application of the present invention, a heavy petroleum feedstock is fractionated in a distillation zone operating under a vacuum to produce an overhead stream comprising a vacuum gas oil, a bottoms stream comprising a vacuum residuum, and a side stream comprising a selected deep cut vacuum gas oil characterized by initial and final cut points within the range of 800° to 1300° F., and demetallizing this selected deep cut gas oil in a demetallation zone to obtain a product characterized by a vanadium content of not more than about 15 ppm and a nickel content of not more than about 10 ppm by weight, whereby the demetallized deep cut vacuum gas oil is made suitable for use as feed to a catalytic cracking zone. Preferably, the vanadium content is less than about 4 ppm and the nickel content less than about 2 ppm. Of course, the selected deep cut gas oil, after demetallation, may be blended with other feed streams to the catalytic cracker to achieve a preselected range of metal contaminants.

In an alternate embodiment, a petroleum vacuum residuum can be fractionated in a separate distillation zone to produce an initial fraction overhead stream comprising a selected distillate fraction, having the characteristics described above, for demetallation according to the present invention. Although requiring a separate distillation zone, this embodiment does not require taking a side stream from a distillation tower. This embodiment can be advantageous for application to certain existing refinery equipment.

By taking such a selected deep cut gas oil fraction and treating only this fraction which is relatively high in metals, the benefit/cost ratio becomes economically attractive for providing additional feed for catalytic cracking. By contrast, if this selected deep cut fraction is simply taken overhead into the entire gas oil fraction by simply increasing the final cut point in the vacuum distillation, then the cost of treating the entire gas oil to remove the metals therefrom becomes prohibitive. This is why the normal final cut point in the commercial distillation of gas oil intended for use as cat cracker feed is normally limited to about 1050° F.

BRIEF DESCRIPTION OF THE DRAWINGS

The process of the invention will be more clearly understood upon reference to the detailed description below in conjunction with the drawings wherein.

DETAILED DESCRIPTION OF THE INVENTION

According to the present process, a selected fraction or distillate of a heavy petroleum feedstock or residuum feedstock is made suitable for use as a feed to a catalytic cracker. The present process comprises distilling the feedstock to obtain a distillate fraction and demetallizing this distillate fraction in a demetallation zone by suitable means.

In the following description of the invention, the term "final cut point" with respect to a distillate is defined as the atmospheric equivalent of the highest boiling material in the distillate. The term "initial cut point" with respect to a distillate is defined as the atmospheric equivalent of the lowest boiling material in the distillate.

The term "petroleum feed or feedstock" as used herein is meant to include virgin petroleum feedstock or a distillate fraction thereof.

The present invention can be used to process various heavy petroleum feedstocks such as whole crude oil, atmospheric bottoms, heavy catalytic cracking cycle oils (HCCO), coker gas oils, vacuum gas oils (VGO) and heavier resids, which normally contain several percent aromatics, particularly large asphaltenic molecules. In the particular case where the feedstock is the atmospheric bottoms or residuum of a refinery pipestill, it typically boils at about 650+° F. Similar feeds derived from petroleum, coal, bitumen, tar sands, or shale oil are also amenable to processing according to the present invention.

Figure 2:
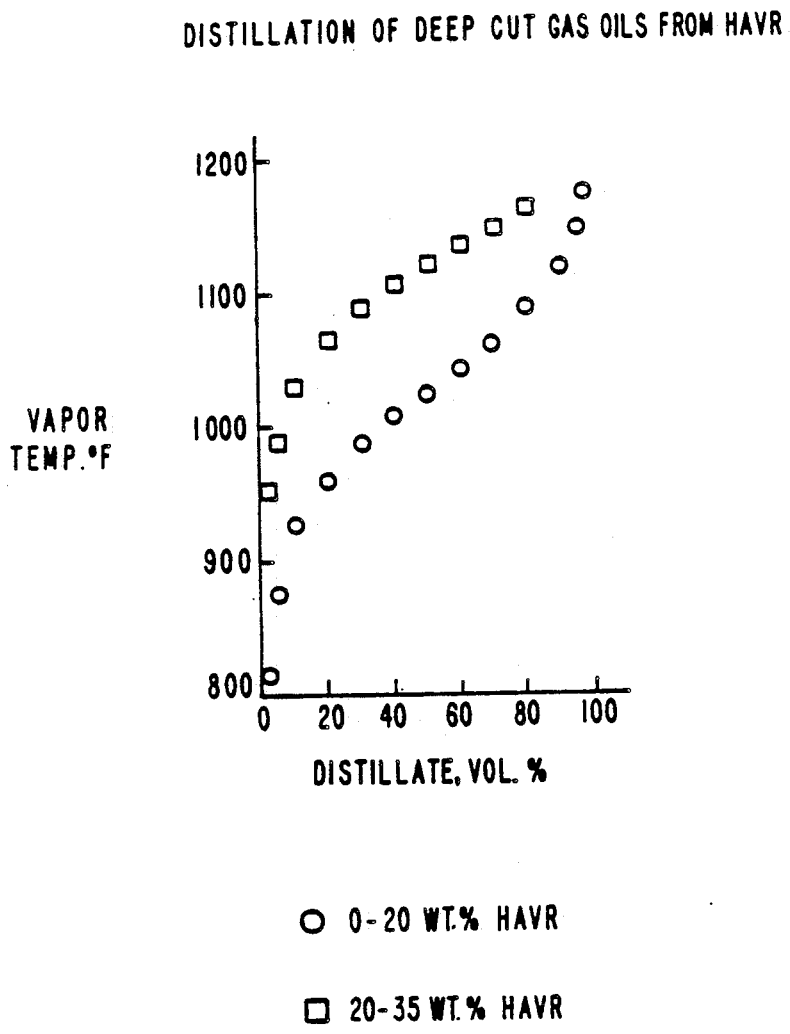
FIG. 2 shows in the form of a graph, distillations of two deep cut gas oils from a heavy Arabian vacuum residuum (HAVR) according to one embodiment of the present invention, in which graph the vapor temperature is plotted versus the distillate volume.

The selected distillate fraction to be demetallized may contain the metals vanadium, nickel, copper, iron and/or others. The average vanadium in the selected distillate is suitably about 15 ppm to 2,000 ppm, preferably about 20 to 1,000 ppm by weight, most preferably about 20 to 100 ppm. The average nickel content in the selected distillate is suitably about 2 to 500 ppm, preferably about 2 to 250 ppm by weight, most preferably about 2 to 100 ppm. For example, a Heavy Arab crude distillate having an initial cut point of 950° F. and a final cut point of 1160° F. as described in FIG. 2 may have a typical nickel content of 8 ppm and a vanadium content of 50 ppm. Selected distillate cuts of high metals crudes such as Hondo/Monterey, Maya, or Bachaquero crudes are also suitable feeds for this invention.

Following demetallation, the average vanadium content of the selected distillate is suitably not more than about 15 ppm, preferably less than about 4, and the average nickel content is suitably not more than about 10, preferably less than about 2 ppm. Greater than 40% by weight of the total vanadium and nickel is removed.

In the particular case where the feedstock is the atmospheric residuum of a refinery pipestill, the selected distillate is a deep cut gas oil taken by vacuum distillation. By deep cut is meant that the selected distillate fraction is intermediate boiling material which may be taken as a side stream of the distillation column which fraction distills at a higher temperature and has a higher metals content than the relatively lighter conventional gas oil product which may be taken as an overhead stream. Such a selected distillate, in this particular case, has the following characteristics. It suitably has a boiling range in the range of about 800° to 1300° F., preferably about 900° to 1300° F., most preferably about 1050° to 1200° F. The initial cut point is suitably in the range of 800° to 1050° F., preferably 900° to 1000° F. The final cut point suitably is in the range of 1050° to 1300° F., preferably 1075° to 1300° F., and most preferably 1100° to 1300° F. It is noted that because of inefficiencies or inaccuracies of the real world, for example due to entrainment or fluctuations in operating conditions, a distillate may contain up to 10 wt. %, usually less than 5 wt. %, of material boiling below the initial cut point. Similarly, as much as 10%, usually less than 5%, of heavy material boiling above the final cut point may be carried over or entrained.

Figure 1:
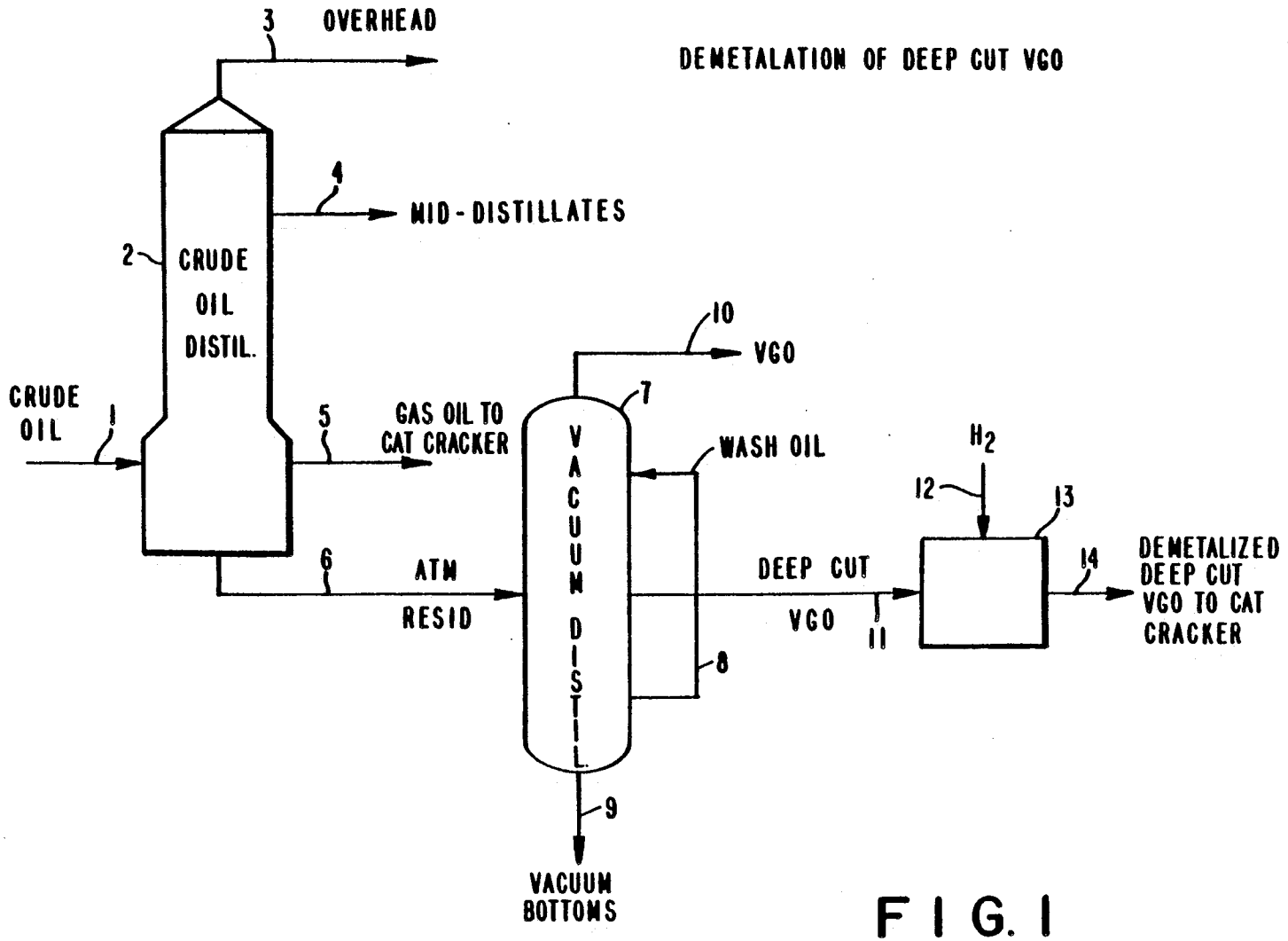
FIG. 1 shows a simplified process flow diagram illustrating one embodiment for practicing the subject invention wherein demetallation of a deep cut vacuum gas oil is accomplished.

FIG. 1 illustrates the particular case where an atmospheric resid is treated according to the present invention. Referring to FIG. 1, a virgin petroleum crude oil stream 1 is fed into a distillation tower 2. Distillation tower 2 can be operated at atmospheric pressure or under a vacuum. For simplicity, the drawing shows a single overhead stream 3, a single intermediate stream 4, etc. Any number of fractions can be recovered from the distillation zone for further refining. A bottoms fraction or petroleum residuum stream 6 having an initial boiling point in the range of 500° to 1000° F., typically about 650° F., is passed to a vacuum tower 7. The vacuum tower 7 produces an overhead stream 10 comprising a relatively high boiling vacuum gas oil (VGO) typically having a distillation range of 650° F. to 1050° F. A side stream 11, comprising a deep cut VGO fraction is removed from the vacuum tower and introduced into a demetallation zone, by way of example, located in a hydrotreater 13. Hydrogen gas, or a gaseous mixture containing hydrogen, e.g., $H_2/H_2S$, in sufficient amounts, in stream 12 is also introduced into the hydrotreater 13, and the VGO fraction is therein treated with the hydrogen in the presence of an effective catalyst. The metals content of the VGO fraction is thereby reduced to a satisfactory preselected level. This demetallized deep cut VGO in line 14 is then suitable as feed for a catalytic cracker.

The vacuum tower 7 also produces a vacuum bottoms stream 9, which is asphaltene rich and typically contains several hundred ppm by weight of metals such as V and Ni. A wash oil stream 8 in the vacuum tower 7 suppresses entrainment of high boiling metal-containing materials.

The present process offers significant advantages over prior art methods for increasing the amount of distillate obtainable from a heavy feedstock or resid, which distillate can be made into a suitable feed to a cat cracker. For example, existing vacuum towers can be readily retrofitted to take a deep VGO side stream, and expensive new process equipment avoided. In fact, the side stream has the required heat (650° F.) for a subsequent hydrotreating reaction. A relatively high feed rate, for example 2 V/V/hr, is suitable for demetallation and the reactor can operate at a relatively low pressure, for example 400 to 800 psig. The capital investment is relatively small and the cost of catalyst is low.

Demetallation of the selected distillate fraction according to the present invention can be accomplished by various means known to those skilled in the art. For example, prior art techniques include hydrotreating, precipitation, and deasphalting.

Hydrotreating: Hydrotreating to remove metals from an oil is well known. A typical hydrotreating process employs a catalyst comprising CoMo on alumina at a total pressure of about 1000 psig, a hydrogen partial pressure of about 650 psia and a temperature of about 700° F. Various fixed bed or slurry hydrotreating processes are well known, as will be readily appreciated by those skilled in the art. A typical demetallation by hydrotreating is disclosed in Example 1 below.

Precipitation: Precipitation to remove metals from an oil can be accomplished by employing a precipitating agent. A well known agent is a combination of $H_2$ and $H_2S$, which reacts with metals in the oil to produce a metal sulfide precipitate. Such a metal removal is exemplified by U.S. Pat. No. 4,430,206 to Rankel.

Deasphalting: The selected cut of the present invention may also be demetallized by deasphalting. Deasphalting is commonly carried out by contacting a residual oil with a liquified normally gaseous non-polar aliphatic hydrocarbon solvent containing 3 to 8 carbon atoms in the molecule. Specifically propane, butane, pentane, hexane or mixtures thereof are conventionally used. When propane is used as the solvent, typical conditions include a temperature in the range of 120° to 195° F., a pressure in the range of 500 to 9000 psig, and a solvent to oil ratio of 0.5 to 8.0. Deasphalting can be carried out in a vessel or tower to which a residual fraction derived form a crude oil is charged through an inlet distributor. The liquified normally gaseous solvent is introduced into the bottom of the tower to flow upwardly in the tower countercurrent to the residual fraction. The deasphalted oil substantially free of metallic contaminants can be withdrawn from the top of the tower and an asphaltene fraction containing substantially all of the metal contaminants can be withdrawn through a lower outlet. Deasphalted oil and solvent are passed overhead, cooled and fed into a flash drum. The solvent is flashed overhead and recycled via a cooler and pump to the tower. Specific methods of deasphalting are disclosed in the art, for example U.S. Pat. Nos. 2,895,902 and 3,511,774, herein incorporated by reference.

The preferred method for accomplishing demetallation of the selected distillate fraction of the present invention is hydrotreating over a catalyst on a high surface area support including at least one metal component from groups VA, VIA and VIIIA of the Periodic Table (Sargent-Welch Scientific Company Periodic Table of the Elements, copyright 1979), e.g., V, Cr, Mo, Fe, Co, and Ni.

The most preferred method for accomplishing demetallation of a selected distillate fraction according to this invention employs a vanadium catalyst composition comprising an activated carbon support. The activated carbon support is suitably a lignite based carbon commercially available from American Norite Company, Inc., Jacksonville, Fla. Particularly preferred carbons are high pore volume, large pore diameter carbons such as DARCO. The DARCO carbon has a bulk density of about 0.42 g/cc, a surface area of about 625 $m^2/g$ or 263 $m^2/cc$, a pore volume of about 1.0 cc/g or 0.42 cc/cc, and an average pore diameter of about 64 Å. The percent vanadium on the carbon in the finished catalyst is suitably about 5 to 50 percent by weight, preferably about 5 to 25 percent. After impregnating the support with the metal, as exemplified below, the catalyst is subjected to standard sulfiding at about atmospheric to 500 psia with about 2 to 15 percent $H_2S$, preferably about 10 percent by volume, while raising the temperature from 200° to 750° F. for a period of 4 hours to 24 hours. This sulfiding activates the catalyst.

EXAMPLE 1

Heavy Arabian vacuum residuum was distilled to obtain the initial 0–33 wt. % lowest boiling fraction with a nominal boiling range of 950°–1300° F. and containing 4.00 wt. % sulfur and 29 wppm vanadium. This petroleum fraction was hydrotreated in a continuous unit over a 1/32" CoMo on $Al_2O_3$ catalyst (containing 3.4 wt. % Co and 10.3 wt. % Mo, 165 Å average pore diameter). The catalyst charge was 25 cc and the reactor was operated upflow at 1.5 liquid hourly spare velocity (LHSV), 550 psia, 1500 SCF/Bbl of 97.2% $H_2$/2.8% $H_2S$ treat gas. The temperature of the treat was varied from 625° to 700° F. over a period of 25 days. Detailed feedstock analyses are given in Table I and hydrotreating results are given in Table II. From this example, it is seen that from Heavy Arabian vacuum residuum (containing 183 wppm V) a yield of 33 wt. % of heavy distillate cut is obtained which contains less than 10 wppm V and is suitable as a cat cracking feedstock.

TABLE I

| Feedstock Properties | | |
|---|---|---|
| Description | Heavy Arab Vacuum Resid (HAVR) | 0–33% Initial Distillation Cut of HAVR |
| Gravity, °API | 7.8 | 13.2 |
| Sulfur, Wt. % | 5.15 | 4.00 |
| Total Nitrogen, wppm | 4510 | 2076 |
| Basic Nitrogen, wppm | — | 382 |
| Carbon, Wt. % | 84.54 | 83.95 |
| Hydrogen, Wt. % | 10.37 | 11.14 |
| Microcarbon Residue, Wt. % | 21.4 | 5.8 |
| Asphaltenes, Wt. % | — | 1.19 |
| Aniline Point, °F. | — | 171 |
| Metals, wppm | | |
| Nickel | 52 | 4 |
| Vanadium | 183 | 29 |
| Iron | 19 | 3 |
| HPLC, Wt. % | | |
| Saturates | — | 20.7 |
| 1 Ring Aromatics | — | 22.5 |
| 2 Ring Aromatics | — | 15.3 |
| 3 Ring Aromatics | — | 10.5 |
| 4+ Ring Aromatics | — | 22.7 |
| Polars | — | 8.3 |
| Distillation, °F. | Hi-Vac C | Hi-Vac C |
| 2% | 877 | 866 |
| 5% | 944 | 909 |
| 10% | 984 | 945 |
| 20% | 1003 | 991 |
| 30% | — | 1019 |
| 40% | — | 1036 |

TABLE II

| Deep Cut VGO Hydrodemetallation over $CoMoAl_2O_3$ Catalyst | | | | | |
|---|---|---|---|---|---|
| Pilot Plant Run | MTE-4, Run 133 | | | | |
| Catalyst | 4.5% CoO, 16% $MoO_3$ on $Al_2O_3$ | | | | |
| Balances | 6–8 | 11–15 | 16–18 | 20–23 | 25–31 |
| Average Days on Oil | 6.5 | 11 | 14.5 | 19 | 24.5 |
| Operating Conditions | | | | | |
| Temperature, °F. | 626 | 650 | 650 | 701 | 700 |
| Inlet $H_2$ partial pressure, psia | 557 | 556 | 542 | 572 | 574 |
| Inlet $H_2S$ partial pressure, psia | 16 | 16 | 73 | 16 | 0 |
| LHSV, $Hr^{-1}$ | 1.50 | 1.38 | 1.37 | 1.40 | 1.43 |
| Treat Gas Rate, SCF/Bbl | 1501 | 1515 | 1636 | 1608 | 1582 |
| Product Qualities | | | | | |
| Gravity, °API | 14.9 | 15.3 | 15.1 | 16.8 | 16.2 |
| Sulfur, Wt. % | 3.50 | 3.28 | 3.56 | 2.69 | 2.87 |
| Vanadium, wppm | 11 | 9 | 10 | 5 | 7 |
| Vanadium Removal, % | 62 | 69 | 66 | 83 | 76 |

EXAMPLE 2

Heavy Arabian vacuum residuum was subjected to distillation to a cup point of 1160° F., whereby 35 wt. % thereof was distilled. A deep cut gas oil, representing the 20–35 wt. % portion of this distillate by weight contains too much metals for use as cat cracker feed. The analysis of this deep cut gas oil is given in column 2 of Table IV below. This deep cut fraction was demetallized to a very low metals content by treating it over a 14/35 mesh supported catalyst, 7.7 wt. % vanadium on high surface area alumina with a gaseous mixture comprising 10% $H_2S$ and 90% $H_2$ (6000 SCF/Bbl) at a pressure of 562 psig and a temperature of 650° F. and a feed rate of 1.5 V/V/hr. The test was conducted in a continuous unit containing 20.00 cc of catalyst in a ⅜" tubular reactor. The results of the test are shown in Table III below.

TABLE III

| Metals Removal with V on Alumina (Run 1) | | |
|---|---|---|
| | Feed | Product |
| V, ppm | 50.3 | 2 |
| Ni, ppm | 8.3 | 2 |
| Conradson Carbon, wt. % | 6.28 | 5.81 |
| S, wt. % | 3.98 | 3.83 |

EXAMPLE 3

This example of a method according to the present invention involved isolation of deep cuts of gas oil (b.p. 800° to 1160° F.) as initial distillation cuts from a petroleum feed source and hydrotreating this material to demetallize it under mild conditions and low pressures while consuming little hydrogen. The distillation is shown graphically in FIG. 2. The demetallation was conducted in a fixed bed tubular reactor with continuous gas and liquid flow under the conditions described in Example 2. The analysis of these two deep cut gas oil fractions are given in Table IV. The feed source was a heavy Arabian vacuum residuum (HAVR) having the characteristics listed in Table I above.

TABLE IV

| Analyses of Deep Cut Gas Oil Fractions from Molecular Distillation of HAVR | | |
|---|---|---|
| | 0–20 Wt. % Cut | 20–35 Wt. % Cut |
| Ni, wppm | 3, 3, 2 | 8, 9, 8 |
| V, wppm | 14, 14, 14 | 51, 50, 50 |
| S, wt % | 3.72 | 3.98 |
| N, wppm | 2019 | 2566 |
| Conradson Carbon, wt % | 3.70, 3.62 | 6.02, 6.51, 6.31 |
| API Gravity | 13.9 | 12.2 |
| $C_7$ Insolubles, wt % | 0.23, 0.21, 0.18 | 0.30 |
| $C_5$ Insolubles, wt % | 1.94, 1.49<br>1.62, 1.68 | 1.07, 1.48<br>1.27, 0.78 |
| Molecular Weight | 640 | 750 |
| C, wt % | 84.38 | 84.17 |
| H, wt % | 11.09 | 10.92 |
| Basic N, wppm | 590 | 613 |

Figure 3:
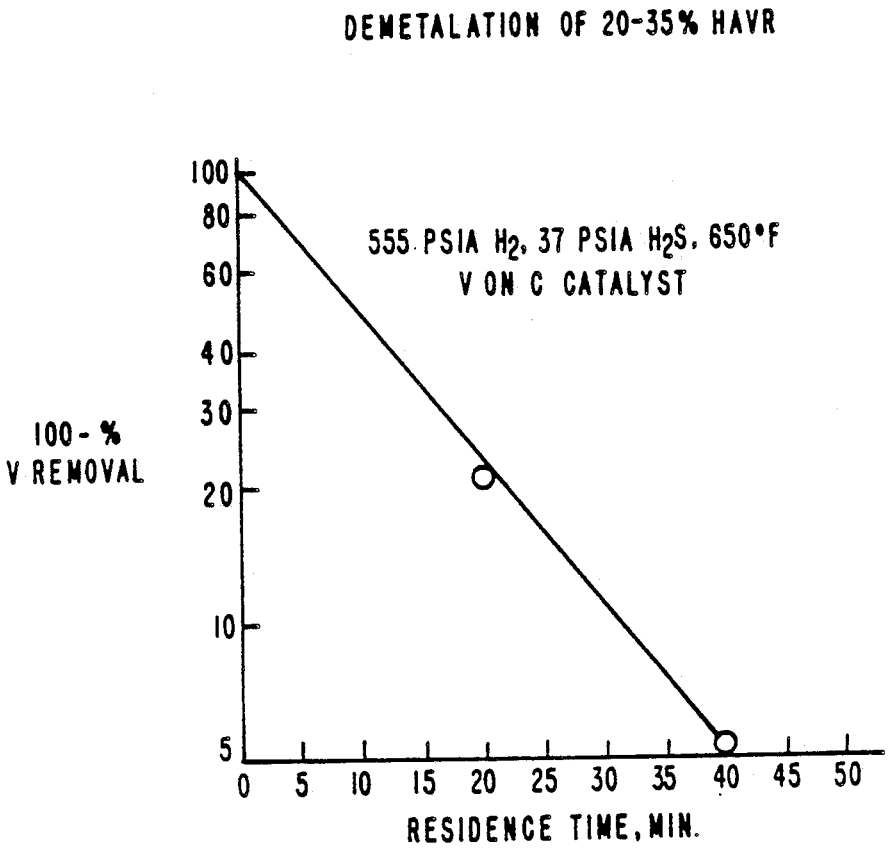
FIG. 3 shows in the form of a graph, a catalytic demetallation of a 20–35 wt. percent distillate cut of a HAVR according to one embodiment of the present invention, in which graph the percent vanadium remaining in the HAVR distillate cut is plotted against the residence time of the HAVR distillate cut in the demetallation zone.

In particular, the feed tested was the 20–35 wt. % cut of HAVR having a metals content of 50 wppm V and 8 wppm Ni. Fixed bed hydrotreatment of this feed using vanadium on commercially available high pore volume large pore diameter activated carbon as the catalyst showed the demetallation reaction to be first order in metals concentration, and independent of the $H_2S$ partial pressure over the range studied (16 to 70 psia). Although the demetallation was first order in $H_2$ partial pressure (over the range 0 to 555 psia), the rate was sufficiently high to allow the desired demetallation at about 500 psi $H_2$ pressure and at 650° F. and 1.5 V/V/hr. The reaction was highly selective with minimal occurrence of other reactions, such as desulfurization or hydrogenation. Hydrogen consumption was only 50 to 150 SCF/Bbl, and there was no detectable gas make. A small reduction in nitrogen occurred. Results of two experiments are shown graphically in FIG. 3 and are tabulated in Table V.

TABLE V

| Demetallation of 20-35% HAVR Cut | | 650° F., 555 psia $H_2$, 37 psia $H_2S$ | |
|---|---|---|---|
| | Feed | Run 28 | Run 29 |
| V/V/Hr. of gas oil | — | 1.5 | 3.0 |
| V, wppm | 50 | 2.7 | 11 |
| Ni, wppm | 8 | 1 | 1 |
| S, wt. % | 3.93 | 3.52 | 3.78 |
| C, wt. % | 84.24 | 84.63 | 84.48 |
| H, wt. % | 10.92 | 11.14 | 11.08 |
| Conradson carbon, wt. % | 6.09 | 5.99 | 5.72 |

EXAMPLE 4

This example illustrates the use of a non-catalytic hydrotreating demetallation step according to the present invention. A 120 g portion of a 0 to 20 weight percent distillation fraction of a heavy Arabian vacuum residuum, as described in column 1 of Table IV, was charged to an autoclave together with 245 psia of $H_2S$ and 800 psia of $H_2$ and 1.67 weight percent on feed of carbon black. The mixture was heated with stirring for 3 hours at 800° F., cooled, filtered and analyzed for vanadium. The vanadium content was reduced from 14 ppm to 2 ppm.

EXAMPLE 5

This example illustrates, in a demetallation step employing a preferred catalyst, the effect of the vanadium loading on the activity of the catalyst. A commercially available carbon support, DARCO activated-carbon used as 14–35 mesh particles was impregnated with vanadium at the various loadings shown in Table VI below, ranging from about 5 percent to about 20 wt. percent on the activated-carbon. The vanadium on carbon was charged to a ⅜" tabular reactor (20.0 cc charge) and was subjected to standard sulfiding. Specifically, the catalyst was sulfided with a gaseous mixture comprising 10.3% hydrogen sulfide in hydrogen for 40 minutes while increasing the temperature from 200° to 450° F. at atmospheric pressure. The catalyst was then maintained at a temperature of 450° F. for 1 hour and 10 minutes. The temperature was increased to 700° F. over a period of 50 minutes and then maintained at 700° F. for 1 hr and 10 min. During this treatment, the gas flow was maintained at an exit rate of 0.40 l/min $H_2$ as measured in a wet test meter at atmospheric conditions after removal of the $H_2S$ by caustic scrubbing. The catalyst was then held overnight at static pressure of 110 psig while decreasing the temperature from 700° F. to 400° F.

The activity of each of the prepared catalysts was tested on the 20–35 weight percent fraction of heavy Arabian vacuum residuum at a total pressure of 775 psig and a temperature of 550° F. at a space velocity of 1.5 V/V/hr. The activity is shown in the last column, indicating that over the range studied the vanadium removal activity of the catalyst increases with increasing percentage of vanadium on the carbon support.

TABLE VI

| Effect of Concentration of V in Catalyst on Demetallation Activity | | |
|---|---|---|
| Run Number | Wt. % Vanadium On Carbon | Vanadium Removal, % |
| 57 | 0 | 0 |
| 59 | 5.00 | 44 |
| 52 | 12.87 | 68 |
| 53 | 12.87 | 64 |
| 60 | 12.87 | 64 |

TABLE VI-continued

| Effect of Concentration of V in Catalyst on Demetallation Activity | | |
|---|---|---|
| Run Number | Wt. % Vanadium On Carbon | Vanadium Removal, % |
| 61 | 16.08 | 80 |

The process of the invention has been described generally and by way of example with reference to particular embodiments for purposes of clarity and illustration only. It will be apparent to those skilled in the art from the foregoing that various modifications of the process and materials disclosed herein can be made without departure from the spirit and scope of the invention.

We claim:

1. A process for producing distillate suitable as feed to a catalytic cracker, the process comprising subjecting a heavy fossil fuel feedstock to distillation in a distillation zone operating under vacuum to obtain a selected distillate fraction characterized by an initial cut point in the range of 800° to 1050° F. and a final cut point in the range of 1075° to 1300° F., and demetallizing the selected distillate fraction only in a demetallation zone, whereby greater than 40 wt. % of the total nickel and vanadium is removed, to obtain a product characterized by a vanadium content of less than about 15 ppm and a nickel content of less than about 10 ppm by weight.

2. A process for producing distillate suitable as feed to a catalytic cracker, the process comprising subjecting a heavy petroleum feedstock to distillation in a zone operating under a vacuum to produce an overhead stream comprising a vacuum gas oil, a bottoms stream comprising a vacuum residuum, and a side stream comprising a deep cut vacuum gas oil characterized by an initial cut point in the range of about 800° to 1050° F. and a final cut point in the range of about 1050° to 1300° F., and demetallizing the deep cut vacuum gas oil only, in a demetallation zone, whereby greater than 40 wt. % of the total nickel and vanadium is removed, to obtain a product characterized by a vanadium content of less than about 15 ppm and a nickel content of less than about 10 ppm by weight.

3. The process of claim 2, wherein the heavy petroleum feed is a atmospheric resid having an initial cut point above about 650° F.

4. The process of claim 2, wherein the separation zone comprises a wash oil which is circulated from a lower portion of the distillation zone to a higher portion of the distillation zone.

5. The process of claim 1, wherein the deep cut vacuum gas oil has a final cut point of about 1100° to 1300° F.

6. The process of claim 1, wherein said feedstock is petroleum crude or a selected distillate cut or resid thereof.

7. The process of claim 1, wherein said feedstock is a vacuum resid of petroleum crude.

8. The process of claim 1, wherein the demetallation zone is a hydrotreating zone.

9. The process of claim 1 or 2, wherein the demetallation zone employs a molybdenum containing catalyst.

10. The process of claim 2, wherein the side stream has a final cut point of 1100° to 1300° F.

11. The process of claim 1, wherein said feedstock is a vacuum residuum and the selected distillate fraction thereof is an overhead initial cut stream from said distillation zone.

12. The process of claim 2, wherein said final cut point is in the range of about 1075° to 1300° F.

13. The process of claim 1, wherein the demetallation zone does not hydrotreat said selected distillation fraction.

14. The process of claim 2, wherein the demetallation zone does not hydrotreat said deep cut gas oil.

* * * * *